US009938863B2

(12) United States Patent
He et al.

(10) Patent No.: US 9,938,863 B2
(45) Date of Patent: Apr. 10, 2018

(54) CAMSHAFT PHASER HAVING CENTRAL BOLT

(71) Applicant: Schaeffler Technologies AG & Co. KG, Herzogenaurach (DE)

(72) Inventors: Yanhua He, Shanghai (CN); Cheng Ou, Shanghai (CN)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 8 days.

(21) Appl. No.: 14/655,432

(22) PCT Filed: Dec. 19, 2013

(86) PCT No.: PCT/CN2013/089950
§ 371 (c)(1),
(2) Date: Jun. 25, 2015

(87) PCT Pub. No.: WO2014/101709
PCT Pub. Date: Jul. 3, 2014

(65) Prior Publication Data

US 2016/0201525 A1 Jul. 14, 2016

(30) Foreign Application Priority Data

Dec. 25, 2012 (CN) ..... 2012 1 0572711

(51) Int. Cl.
*F01L 1/04* (2006.01)
*F01L 1/047* (2006.01)
*F01L 1/344* (2006.01)

(52) U.S. Cl.
CPC ..... *F01L 1/344* (2013.01); *F01L 1/047* (2013.01); *F01L 1/3442* (2013.01);
(Continued)

(58) Field of Classification Search
CPC ..... F01L 1/047; F01L 1/344; F01L 1/3442; F01L 2001/3445; F01L 2001/34456; F01L 2001/34483; F01L 1/34
(Continued)

(56) References Cited

U.S. PATENT DOCUMENTS 6,450,137 B2 9/2002 Ogawa
6,935,291 B2 8/2005 Kusano et al.
(Continued)

FOREIGN PATENT DOCUMENTS

CN 101769183 7/2010
CN 101900005 A 12/2010
(Continued)

OTHER PUBLICATIONS

English Machine Translation of CN101769183A. Translated from Espacenet on Nov. 14, 2016.*

*Primary Examiner* — Mark Laurenzi
*Assistant Examiner* — Paul Thiede
(74) *Attorney, Agent, or Firm* — Volpe and Koenig, P.C.

(57) ABSTRACT

A camshaft phaser having a central bolt is provided. The camshaft phaser includes: a stator and a rotor which is connected with a camshaft in a torsion-resistant manner and accommodated in the stator; a front cover and a rear cover respectively set at a front side and a back side of the stator; and a compression spring having a first end buckled with the front cover, and a second end fixed to the rotor, wherein the central bolt is installed inside the camshaft phaser through an opening set on the front cover, and the central bolt is configured with a guide part which is adapted for pushing the compression spring to an accurate position. Therefore, a supporting apparatus for supporting the spring is no longer required to be configured in the camshaft phaser, structure of
(Continued)

the camshaft phaser is optimized, and manufacturing cost of the camshaft phaser is reduced.

6 Claims, 4 Drawing Sheets

(52) U.S. Cl.
CPC ..... *F01L 2001/3445* (2013.01); *F01L 2001/34456* (2013.01); *F01L 2001/34483* (2013.01)

(58) Field of Classification Search
USPC ..... 123/90.17, 90.15
See application file for complete search history.

(56) References Cited

U.S. PATENT DOCUMENTS

| | | | |
|---|---|---|---|
| 2005/0252468 | A1 | 11/2005 | Tanaka et al. |
| 2012/0160196 | A1 | 6/2012 | Sakane |
| 2013/0167787 | A1 | 7/2013 | Noguchi et al. |

FOREIGN PATENT DOCUMENTS

| | | |
|---|---|---|
| CN | 102562202 | 7/2012 |
| DE | 102004060176 | 7/2005 |
| JP | 2001241306 | 9/2001 |
| WO | 2012056874 | 5/2012 |

* cited by examiner

CAMSHAFT PHASER HAVING CENTRAL BOLT

TECHNICAL FIELD

The present disclosure generally relates to the technical field of internal combustion engine, and more particularly, to a camshaft phaser with a central bolt adapted to be applied in the technical field of internal combustion engine.

BACKGROUND

In an internal combustion engine with a mechanical valve controller, scavenging air valve therein is controlled by a cam of a camshaft driven by a crankshaft. When phase between the crankshaft and the camshaft is fixed, a valve timing of the valve can be thus determined by arrangement and shape of the cam. According to the current working condition of the internal combustion engine, the valve timing of the valve can be adjusted by controlling the phase between the crankshaft and the camshaft, for achieving beneficial effects, such as reduced fuel consumption and less hazardous substance generated. This kind of apparatus for freely adjusting the phase between the crankshaft and the camshaft is referred to as a camshaft phaser.

Chinese patent application No. 201010212448.1 discloses a camshaft phaser. The camshaft phaser includes: an external rotor connected with a crankshaft in a drive manner, which is also referred to as a stator; an internal rotor concentrically set in a cavity of the stator, which is also referred to as a rotor; a front cover; a rear cover; a spring; and a plurality of mounting bolts. The front cover and the rear cover are respectively set at two sides of the stator, and the mounting bolts run through the stator so as to combine the front cover and the rear cover together. The spring has one end fixed on the front cover, and another end fixed on the rotor, thus the rotor is connected with the stator in a torsion-resistant manner. The spring is a compression one and extends for a certain distance along the axial direction. If there is no support for the spring, the spring will slant within the rotor, which may affect the installation process of the central bolt when fixing the rotor to the camshaft. Accordingly, in the camshaft phaser disclosed in this patent application, the front cover is configured to extend inwardly to form an annular supporting apparatus for supporting the front end of the spring, so as to effectively prevent the spring from slanting.

U.S. Pat. No. 6,450,137 also discloses a similar camshaft phaser, wherein a supporting apparatus is configured on the front cover or configured separately to prevent the spring from slanting. However, when the front cover is configured with a supporting apparatus, dimension of the front cover is increased and additional manufacturing cost is required. Furthermore, the supporting apparatus separately formed will increase the complexity of assembling the camshaft phaser and the manufacturing cost as well.

Therefore, a new camshaft phaser is needed.

SUMMARY

Embodiments of the present disclosure provide a camshaft phaser with a central bolt, which is simple in structure.

An embodiment in the present disclosure is as follows. A camshaft phaser with a central bolt is provided, including: a stator and a rotor connected with a camshaft in a torsion-resistant manner, wherein the rotor is accommodated in the stator, and a plurality of working cavities are formed between the rotor and the stator; a front cover and a rear cover respectively set at a front side and a back side of the rotor, which are combined together with the stator via a plurality of bolts; and a compression spring with a first end buckled with an outer portion of the front cover, and a second end fixed on the rotor, wherein the central bolt is installed inside the camshaft phaser via an opening set on the front cover, and the central bolt is configured with a guide part which is adapted to push the compression spring to an accurate position.

In comparison with existing technologies, the present disclosure has following advantages: the guide part of the central bolt can push the compression spring to an accurate position. As such, a supporting apparatus for supporting the spring is no longer required to be configured in the camshaft phaser. Accordingly, structure of the camshaft phaser is optimized, and manufacturing cost of the camshaft phaser is reduced.

DETAILED DESCRIPTION

In order to clarify the objects, characteristics and advantages of the present disclosure, embodiments of the present disclosure will be described in detail in conjunction with the accompanying drawings. The disclosure will be described with reference to certain embodiments. Accordingly, the present disclosure is not limited to the embodiments disclosed. It will be understood by those skilled in the art that various changes may be made without departing from the spirit or scope of the disclosure.

Figure 1:
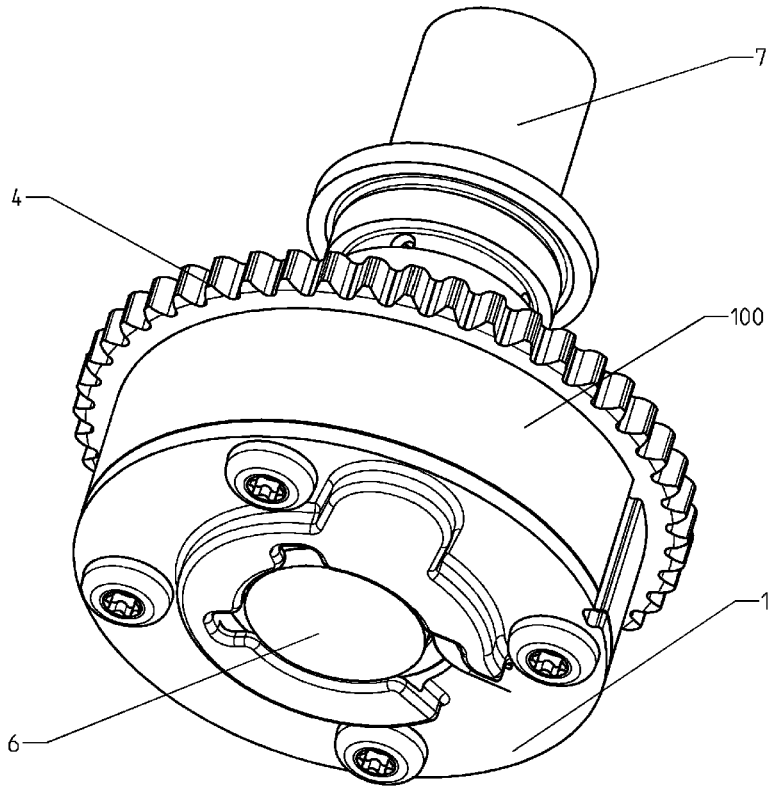
FIG. 1 schematically illustrates a perspective view of a camshaft phaser according to one embodiment of the present disclosure.
Figure 2:
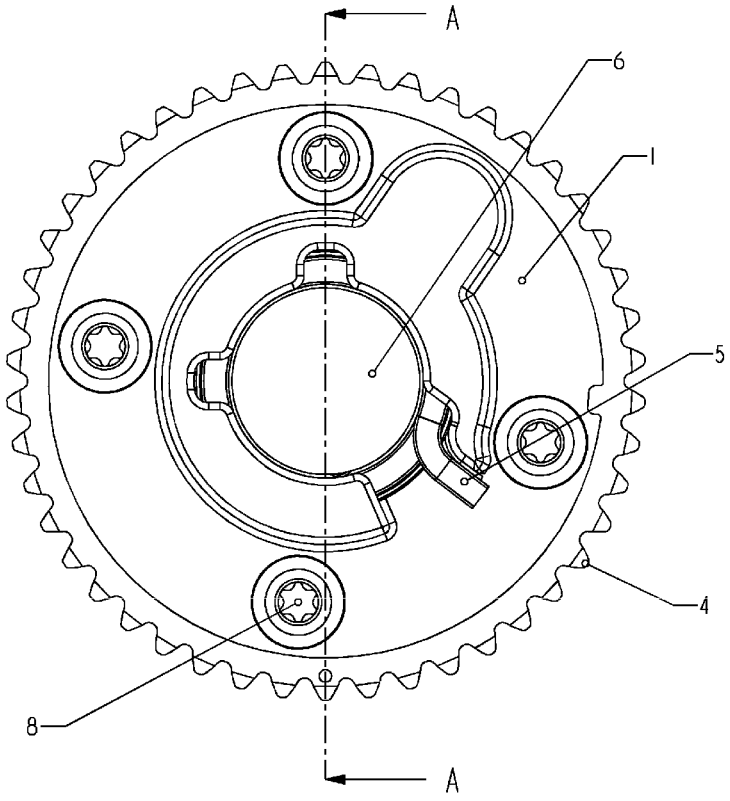
FIG. 2 schematically illustrates a front view of the camshaft phaser shown in FIG. 1.
Figure 3:
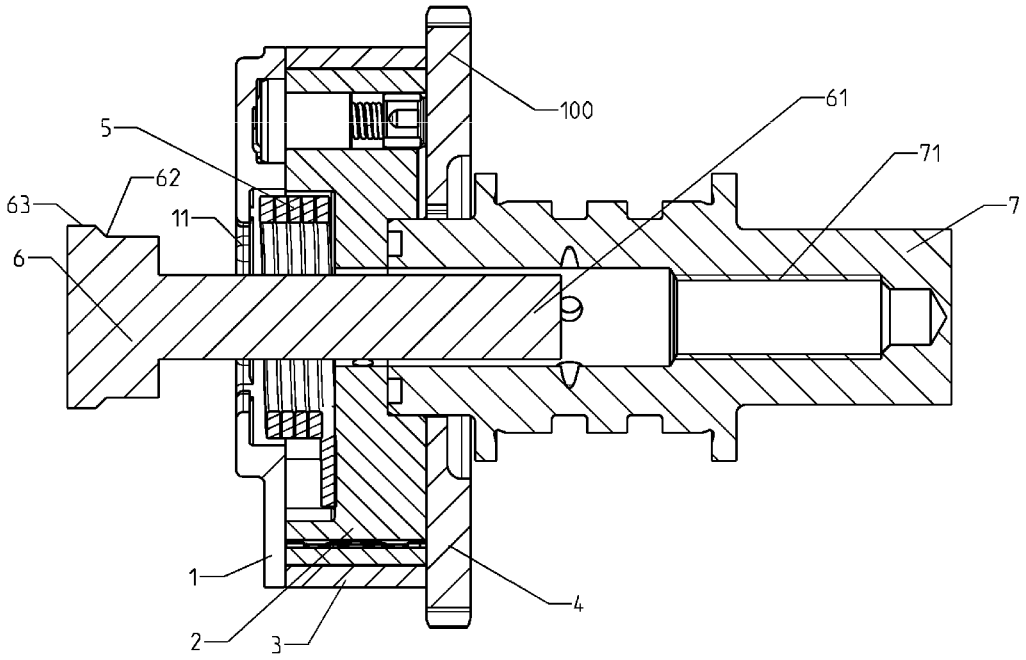
FIG. 3 schematically illustrates a sectional view along line A-A of the camshaft phaser shown in FIG. 2, wherein a central bolt is partially installed into the camshaft phaser.

Referring to FIG. 1 to FIG. 3, a camshaft phaser 100 is illustrated, including a stator 3 and a rotor 2 connected with a camshaft 7, wherein the stator 3 is driven by a crankshaft of an internal combustion engine which is not shown in FIG. 1 to FIG. 3. A plurality of working cavities are configured between the stator 3 and the rotor 2, wherein the plurality of working cavities is defined by protrusions radially and inwardly extending from the stator 3 and supported by the rotor 2. Each of the plurality of working cavities is divided into two sub-working cavities by a wing plate formed on the rotor 2 (separately or integrally formed on the rotor 2). Pressure medium is applied to the plurality of sub-working cavities, so as to change a relative rotation position of the rotor 2 with respect to the stator 3, and change a relative rotation position of the camshaft with respect to the crankshaft.

A front cover 1 and a rear cover 4 are set at a front side and a back side of the stator 3, respectively, wherein the front cover 1, the stator 3, and the rear cover 4 are combined together via a plurality of bolts 8. The rotor 2 is accommodated inside the stator 3. To ensure a torsion-resistant connection between the stator 3 and the rotor 2, one side of the rotor 2 is installed with a spiral compression spring 5. The compression spring 5 is set along the axial direction of the rotor 2, and extends for a certain distance along the axial direction. The compression spring 5 has a first end buckled with the front cover 1, and an opposite second end buckled with the rotor 2. The front cover 1 and the stator 3 are combined together, thus the compression spring 5 can ensure the torsion-resistant connection between the rotor 2 and the stator 3. It should be noted that, as the first end of the compression spring 5 is buckled with an outer portion of the front cover 1, the front cover 1 is not required to be configured with a fixing apparatus for fixing the first end of the compression spring. As such, the axial dimension of the entire camshaft phaser 100 will not increase due to configuration of the front cover 1.

The camshaft 7 has one end pressed against the rotor 2 and is configured with a shaft hole 71 therein for accommodating the central bolt 6, wherein the central bolt 6 is adapted to fix the camshaft phaser 100 to the camshaft 7. The central bolt 6 includes a slender body part 61, a head part 63, and a guide part 62 connecting the body part 61 and the head part 63. The guide part 62 is configured with a slope on its surface, wherein one end of the guide part 62 close to the head part 63 has a dimension larger than that of another end of the guide part 62 close to the body part 61. Outer surface of the body part 61 is configured with a plurality of external threads (not shown), and inner surface of the camshaft 7 is configured with a plurality of internal threads (not shown), and these external threads and these internal threads are able to engaged with each other, so as to fix the central bolt inside the camshaft 7.

Figure 4:
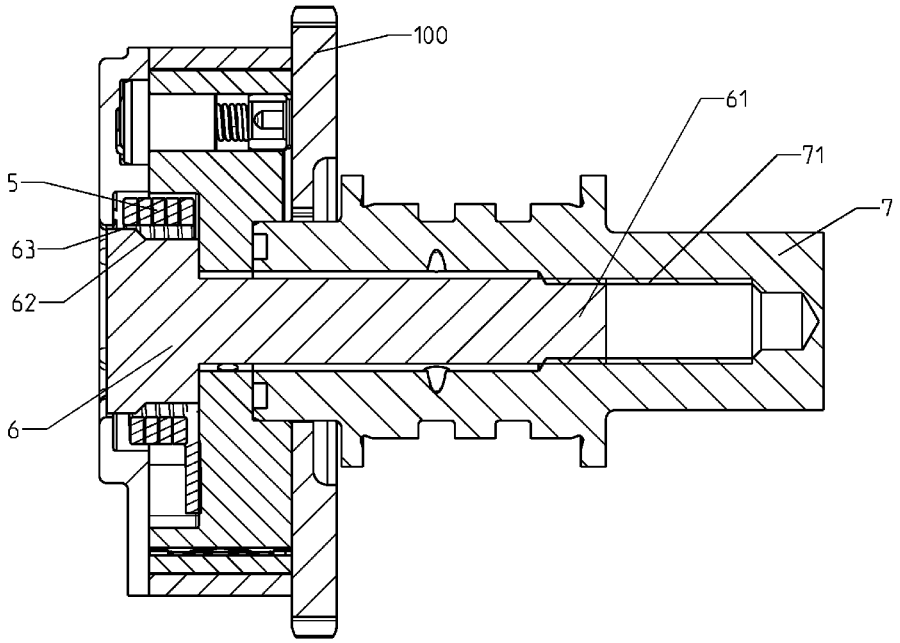
FIG. 4 schematically illustrates a sectional view along line A-A of the camshaft phaser shown in FIG. 2, wherein a central bolt is entirely installed into the camshaft phaser.

As shown in FIG. 3 and FIG. 4, the central bolt 6 is able to be inwardly inserted into the camshaft phaser 100 from an opening 11 set on a central portion of the front cover 1. The body part 61 of the central bolt 6 will enter into the shaft hole 71 of the camshaft 7 firstly, and with the body part 61 being inserted into the shaft hole 71 further, the guide part 62 of the central bolt 6 will then move inside the compression spring 5. In this circumstance, if the compression spring 5 cants or tilts, the guide part 62 will push the compression spring 5 from the inside of the compression spring 5 until the head part 63 is supported inside the compression spring 5. Due to the configuration of the guide part 62, even if the compression spring 5 cants or tilts, the central bolt 6 is able to be installed normally, as the guide part 62 is able to guide the compression spring 5 back to an accurate position. Accordingly, a supporting apparatus for supporting the compression spring 5 is not required to be configured in the camshaft phaser 100, thus structure of the camshaft phaser 100 is optimized, and manufacturing cost of the camshaft phaser 100 is reduced.

Although the present disclosure has been disclosed above with reference to preferred embodiments thereof, it should be understood by those skilled in the art that various changes may be made without departing from the spirit or scope of the disclosure. Accordingly, the present disclosure is not limited to the embodiments disclosed.

What is claimed is:

1. A camshaft phaser with a central bolt, comprising:

a stator;

a rotor configured to be connected with a camshaft in a torsionally-fixed manner, wherein the rotor is accommodated in the stator;

a plurality of working cavities formed between the rotor and the stator;

a front cover and a rear cover respectively arranged at a front side and a back side of the stator, which are combined with the stator through a plurality of bolts;

a compression spring having a first end connected with an outer portion of the front cover and a second end fixed to the rotor; and the central bolt installed inside the camshaft phaser through an opening on the front cover, and the central bolt includes a sloped guide part that contacts and positions the compression spring during installation of the central bolt inside the camshaft phaser.

2. The camshaft phaser according to claim 1, wherein the central bolt comprises a head part and a slender body part, wherein the sloped guide part is axially positioned between the head part and the slender body part, and when the central bolt is entirely installed inside the camshaft phaser, the head part provides a radial support to the compression spring and the sloped guide part is aligned in a radial direction with the compression spring.

3. The camshaft phaser according to claim 2, wherein the sloped guide part has a slope defined by an acute angle with respect to an axis of the central bolt, and a dimension of the sloped guide part close to the head part is larger than a dimension of the sloped guide part close to the slender body part.

4. The camshaft phaser according to claim 1, wherein the opening on the front cover is configured to be aligned with a shaft hole defined by the camshaft for installing the central bolt.

5. The camshaft phaser according to claim 2, wherein the opening on the front cover is configured to be aligned with a shaft hole defined by the camshaft for installing the central bolt.

6. The camshaft phaser according to claim 3, wherein the opening on the front cover is configured to be aligned with a shaft hole defined by the camshaft for installing the central bolt.

* * * * *